US008366472B2

(12) United States Patent
Miyamoto

(10) Patent No.: US 8,366,472 B2
(45) Date of Patent: Feb. 5, 2013

(54) CONNECTOR

(75) Inventor: Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/249,351

(22) Filed: Sep. 30, 2011

(65) Prior Publication Data

US 2012/0088389 A1 Apr. 12, 2012

(30) Foreign Application Priority Data

Oct. 8, 2010 (JP) ..... 2010-228894

(51) Int. Cl.
*H01R 4/50* (2006.01)

(52) U.S. Cl. ..... 439/345

(58) Field of Classification Search ..... 439/345, 439/752, 680, 587, 271–272, 275, 595, 357
See application file for complete search history.

(56) References Cited

U.S. PATENT DOCUMENTS 5,879,201 A 3/1999 Fukamachi et al.
6,332,797 B1 * 12/2001 Taguchi et al. ..... 439/275
6,358,101 B1 * 3/2002 Noro et al. ..... 439/752
6,863,568 B2 * 3/2005 Nakamura ..... 439/595
7,500,887 B2 * 3/2009 Ichio ..... 439/752
2005/0245124 A1 * 11/2005 Katsuma ..... 439/357

* cited by examiner

*Primary Examiner* — Jean F Duverne

(74) *Attorney, Agent, or Firm* — Gerald E. Hespos; Michael J. Porco

(57) ABSTRACT

A connector (10) has first and second housings (20, 40). The first housing (20) has a tubular hood (21) with opposite first and second surfaces and the second housing (40) can be fit in the tubular hood (21). A terminal fitting (80) and a retainer (60) are mounted in the second housing (40). A guide (29) projects from the second inner surface of the hood (21), and a striking part (27) projects from the first inner surface of the hood (21). The second housing (40) slides along the guide (29) in a process of fitting the second housing (40) in the hood (21) and is displaced toward the striking part (27). The retainer (60) projects from the second housing (40) prior to complete insertion and will strike against the striking part (27) to prevent the second housing (40) from fitting farther into the hood (21).

10 Claims, 7 Drawing Sheets

CONNECTOR

BACKGROUND OF THE INVENTION

1. Field of the Invention

The invention relates to a connector.

2. Description of the Related Art

U.S. Pat. No. 5,879,201 discloses a connector with a first housing with a tubular hood and a second housing that can be fit in the hood of the first housing. A terminal fitting and a retainer are mounted on the second housing. The retainer is movable between a temporary locking position and a main locking position. The terminal fitting can be inserted into the second housing and removed therefrom when the retainer is in the temporary locking position. However, the terminal fitting is prevented from being removed from the second housing when the retainer is in the main locking position. A projection is formed on the retainer and interferes with the opening edge of the hood when the retainer is at the temporary locking position. Thus, the second housing cannot fit in the hood, thereby indicating that the retainer is in a partly inserted state.

A predetermined clearance is provided between the inner surface of the hood and the outer surface of the second housing when the second housing is fit in the first housing to prevent excessively large fit-in resistance between the housings. However, the clearance allows the second housing to move freely in the hood. Thus even when the retainer is in the half-inserted state, there is a possibility that the projection enters the hood and hence there is a fear that the second housing is fit forcibly in the hood.

The invention has been completed in view of the above-described situation and it is an object of the invention to detect with certainty that a retainer is in a half-inserted state.

SUMMARY OF THE INVENTION

The invention provides a connector having a first housing with a tubular hood and a second housing that can be fit in the tubular hood of the first housing. A terminal fitting and a retainer are mounted on the second housing. The retainer can be inserted deeply into the second housing to prevent the terminal fitting from being removed from the second housing. A guide projects from a first inner surface of the hood and a striking part projects from a second inner surfaces of the hood, which is opposed to the first inner surface. The second housing slides along the guide in a process of fitting the second housing in the hood and is displaced toward the striking part. The retainer strikes against the striking part if the retainer is not inserted into the second housing to a proper depth so that the second housing cannot be inserted farther into the hood.

A front end of the guide part preferably is more distant from a rear wall of the hood than a front end of the striking part. This construction is simple, and yet the guide part securely guides the second housing, and the partly inserted retainer is certain to strike against the striking part.

The retainer preferably is disposed approximately in a middle of the second housing in a direction in which the second housing is fit in the hood of the first housing. Thus, it is possible to detect that the retainer is in the partly-inserted state when the second housing is fit in the hood in a certain degree of depth. Consequently the connector reliably detects the partly-inserted state of the retainer.

Striking parts may be disposed at a central portion and left and right end portions of the first housing in a width direction orthogonal to the direction in which the second housing is fit in the hood of the first housing. The second housing may incline leftward or rightward during insertion into the hood. However, the partly inserted retainer will strike against the left or right striking part to prevent further insertion into the hood. Consequently the connector detects partial insertion of the retainer with high reliability.

DETAILED DESCRIPTION OF THE PREFERRED EMBODIMENTS

Figure 1:
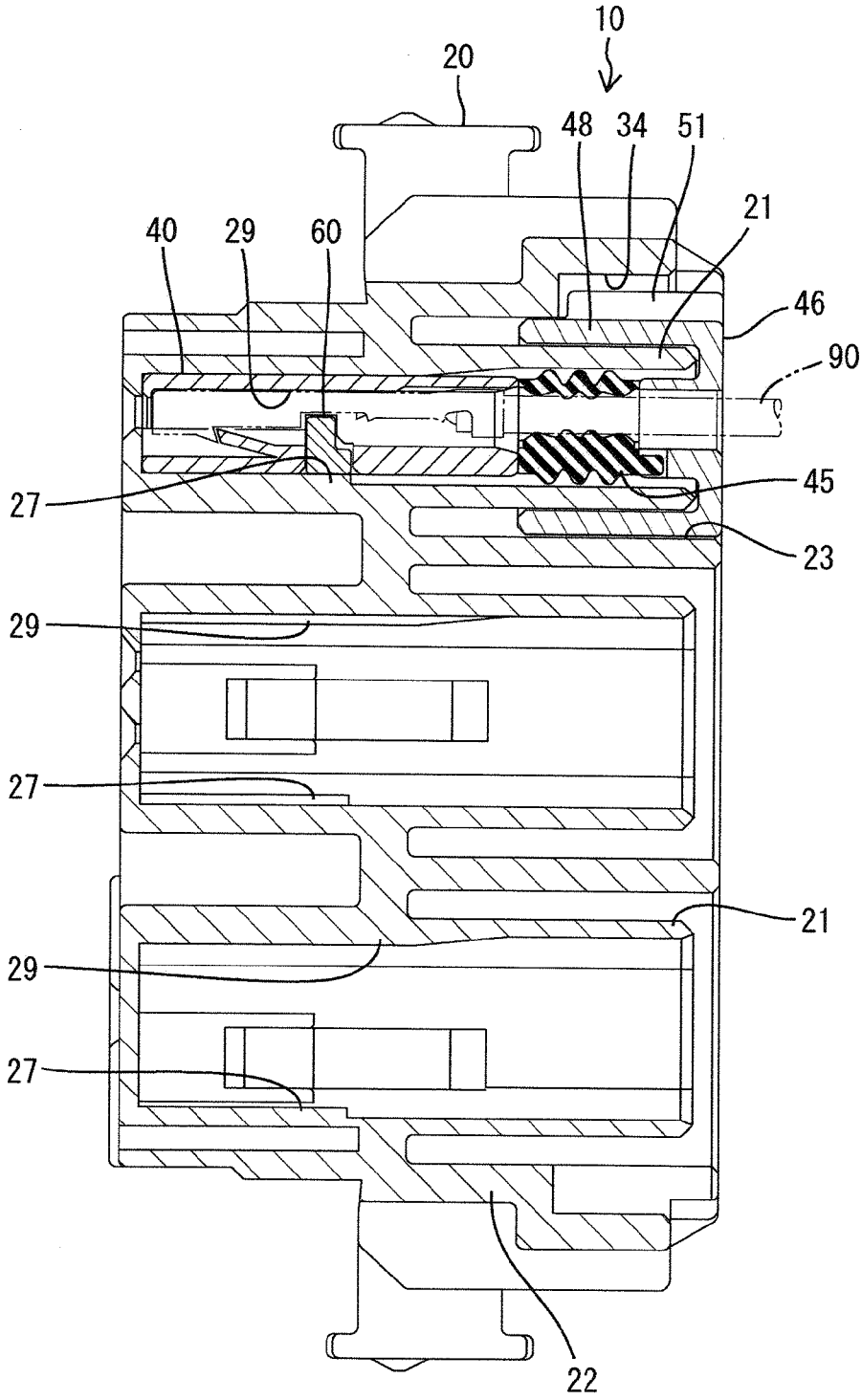
FIG. 1 is a sectional view of a connector in accordance with the invention.

A connector in accordance with the invention is identified by the numeral 10 in FIGS. 1 through 9. The connector 10 has a first housing 20 and a second housings 40 that can be fit in the first housing 20. Ends of the first and second housings 20 and 40 that are fit together are referred to herein as the front ends.

The first housing 20 is made of synthetic resin. As shown in FIGS. 2 through 9, plural hoods 21 project at a front end of the first housing 20 and the second housings 40 can be fitted respectively in the hoods 21. The hoods 21 are of different sizes, with large hoods 21 disposed at a central portion of the first housing 20 in a vertical direction and small hoods 21 disposed at both ends of the first housing 20 in the vertical direction. A surrounding wall 22 surrounds the periphery of each hood 21 and a space 23 is defined between the hoods 21 and the surrounding wall 22.

Figure 9:
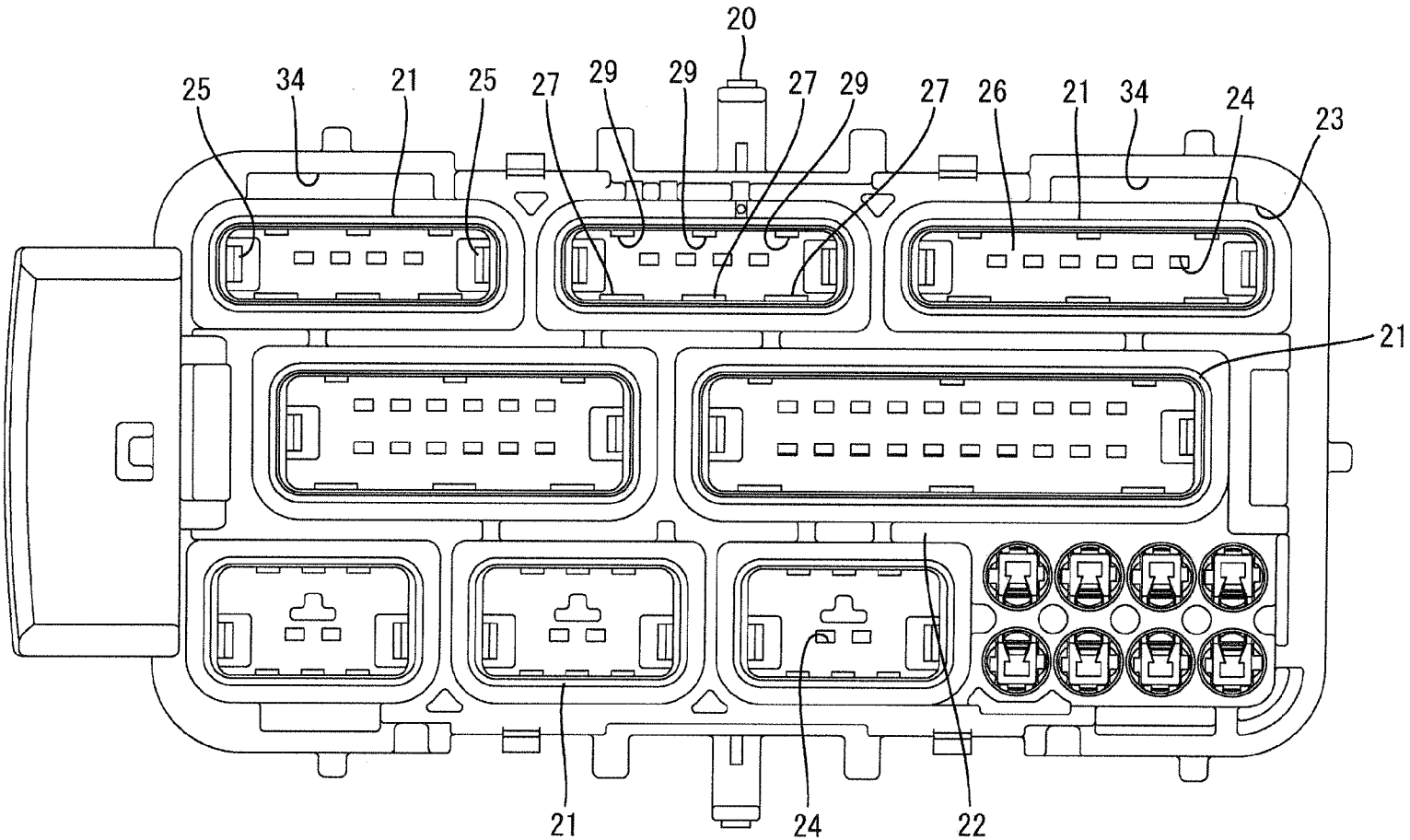
FIG. 9 is a front view of the first housing.

Tab insertion openings 24 are formed through a rear wall 26 of each hood 21 and can receive male tabs of an unillustrated mating connector. As best shown in FIG. 9, two flexible lock-receiving parts 25 project on left and right inner surfaces of each hood 21.

Striking parts 27 project from lower inner surfaces of the hoods 21. Each striking part 27 is long narrow rib that extends forward from the rear wall 26 of each hood 21 in the longitudinal direction (the direction in which the second housing 40 is fit in the hood 21). The front end of the striking part 27 is positioned rearward from the center of the hood 21 in the longitudinal direction thereof. The striking part 27 has a striking surface 28 erect approximately perpendicularly in the vertical direction. As best shown in FIG. 9, the striking parts 27 are disposed at central portions and both end portions of the lower inner surface of the hood 21 in the width direction.

Long narrow rib-shaped guides 29 project from an upper inner surface of each hood 21. The rib-shaped guides 29 extend forward from the rear wall 26 of each hood 21 in the longitudinal direction and are narrower than the striking parts 27. The front end of each guide 29 is more distant from the rear wall 26 of the hood 21 than the front end of the striking part 27. Thus, the front end of the guide part 29 is nearer to the front opening of the hood 21 than the front end of the striking part 27.

Each hood 21 is thinned gradually from approximately its center toward its front end in the longitudinal direction to form a cut-off part (see FIG. 2) 30 at the front end of the guide 29. A tapered guide surface 31 is formed on a lower surface of each cut-off part 30. The cut-off part 30 is at a position where the cut-off part 30 and the striking part 27 do not longitudinally overlap each other. The guides 29 are disposed at the central portions and both end portions of the upper inner surface of the hood 21 in the width direction thereof by spacing the guides 29 from each other at certain intervals in such a way that the guides 29 and the striking parts overlap each other in the width direction of the hood 21.

The second housing 40 is made of synthetic resin and has a wide flat block shaped housing body 41, as shown in FIGS. 5 through 8. Cavities 42 penetrate the housing body 41 longitudinally and are disposed in a row in the width direction of the second housing 40. An elastically flexible lance 43 projects forward from a lower inner surface of each cavity 42. A terminal fitting 80 is inserted into each cavity 42 from the rear and the lance prevents the normally inserted terminal fitting 80 from being removed from the cavity 42.

The terminal fitting 80 is formed unitarily by bending a conductive metal plate. The terminal fitting 80 has a tubular terminal fitting connection part 81 connectable with a tab of a mating terminal fitting inserted into the cavity 42 and an electric wire connection part 82 rearward of the terminal fitting connection part 81. The electric wire connection part 82 is connected to an end of the electric wire 90 by crimping the electric wire connection part 82 thereto. Two locking parts 83 project from left and right outer surfaces of the housing body 41. Each locking part 83 is divided into upper and lower portions.

A mounting hole (see FIG. 5) 44 is formed through a lower surface of the housing body 41 for mounting the retainer 60 on the second housing 40. The mounting hole 44 is a long narrow slit and has a depth sized so that the mounting hole 44 communicates with all of the cavities 43. The mounting hole 44 is disposed immediately rearward from the root of the lance 43 and approximately at the center of the housing body 41 in its longitudinal direction.

The retainer 60 has a long narrow retainer body 61 and locking projections 62 project from an upper surface of the retainer body 61. The retainer 60 is movable on the second housing 40 between a temporary locking position and a main locking position. At the temporary locking position, a lower end of the retainer body 61 projects from the lower surface of the housing body 41, and the locking projections 62 are spaced from the cavities 42. Thus, the terminal fittings 80 can be inserted into the cavities 42 and the removed therefrom. On the other hand, the retainer body 61 is pressed into the housing body 41 at the main locking position. As a result, the lower surfaces of the retainer body 61 and the housing body 41 become almost flush with each other, and at this time, each locking projection 62 moves into the corresponding cavity 42 and is at a position where the locking projection 62 can lock the terminal fitting 80 thereto. Thus, the terminal fitting 80 is cannot be removed from the cavity 42.

A rubber seal 45 is mounted on a rear end of the housing body 41 from the rear. A cover 46 is mounted on the rear end of the housing body 41 from the rear to prevent the seal 45 from being removed from the housing body 41. A hold-down part 47 is formed on the cover 46 and contacts the seal 45 from the rear. The tubular peripheral part 48 also is formed on the cover 46 and projected out from the hold-down part 47, which covers the periphery of the seal 45. An electric wire close-contact hole 49 penetrates through the hold-down part 47 and closely contacts the electric wire 90. An electric wire insertion hole 50 penetrates through the hold-down part 47 and receives the electric wire 90. The terminal fitting 80 is inserted into the cavity 42 from the electric wire insertion hole 50 through the electric wire close-contact hole 49. In a state in which the terminal fitting 80 is inserted correctly into the cavity 42, the peripheral surface of the electric wire 90 is brought into close contact with the inner peripheral surface of the electric wire close-contact hole 49. The peripheral surface of the seal 45 is brought into close contact with the inner peripheral surface of the hood 21 when the second housing 40 is fit correctly in the hood 21. Thereby the gap between the electric wire 90 and the second housing 40 is liquid-tightly sealed through the seal 45.

Ribs 51 are formed on an upper outer surface of the peripheral part 48 for preventing the second housing 40 from being fit erroneously in the hood 21. The ribs 51 can be fit respectively on rib-receiving parts 34 formed on the first housing 20. Each rib 51 moves into the corresponding rib-receiving part 34 when the second housing 40 is fit in the hood 21 in a correct posture to permit an operation of fitting the second housing 40 in the hood part 21. The ribs 51 interfere with the front edge of the hood 21 when an operator holds the second housing 40 upside down to prevent the second housing 40 from being inserted in the hood 21.

Initially the front ends of the first and second housings 20 and 40 are opposed to each other so that the second housing 40 can be inserted in the hood 21. The upper surface of the second housing 40 slides along the guide surface 31 of the guide 29 in the process of fitting the second housing 40 in the hood 21. As a result, the second housing 40 is displaced down toward the striking part 27. The retainer 60 that has been pressed into the second housing 40 to the main locking position does not strike against the striking surface 28 of the striking part 27, but rather the lower surfaces of the retainer body 61 (see FIG. 5) and the housing body 41 contact the upper surface of the striking part 27. Thus, the second housing 40 can be pressed into the hood 21 so that the lower surfaces of the retainer body 61 and the housing body 41 slide along the upper surface of the striking part 27, with the upper surface of the housing body 41 sliding along the lower surface of the guide part 29. As a result, the second housing 40 is fit in the hood 21 to a normal depth (see FIG. 1). The locking part (see FIG. 8) 83 elastically locks the locking-receiving part 25 when the second housing 40 is fit normally in the first housing 20 to hold the first and second housings 20 and 40 in a fit-in state. At this time, the hood 21 is sandwiched between the seal 45 and the peripheral part 48, and the rear end of the cover 46 becomes almost flush with the front end of the first housing 20.

Figure 2:
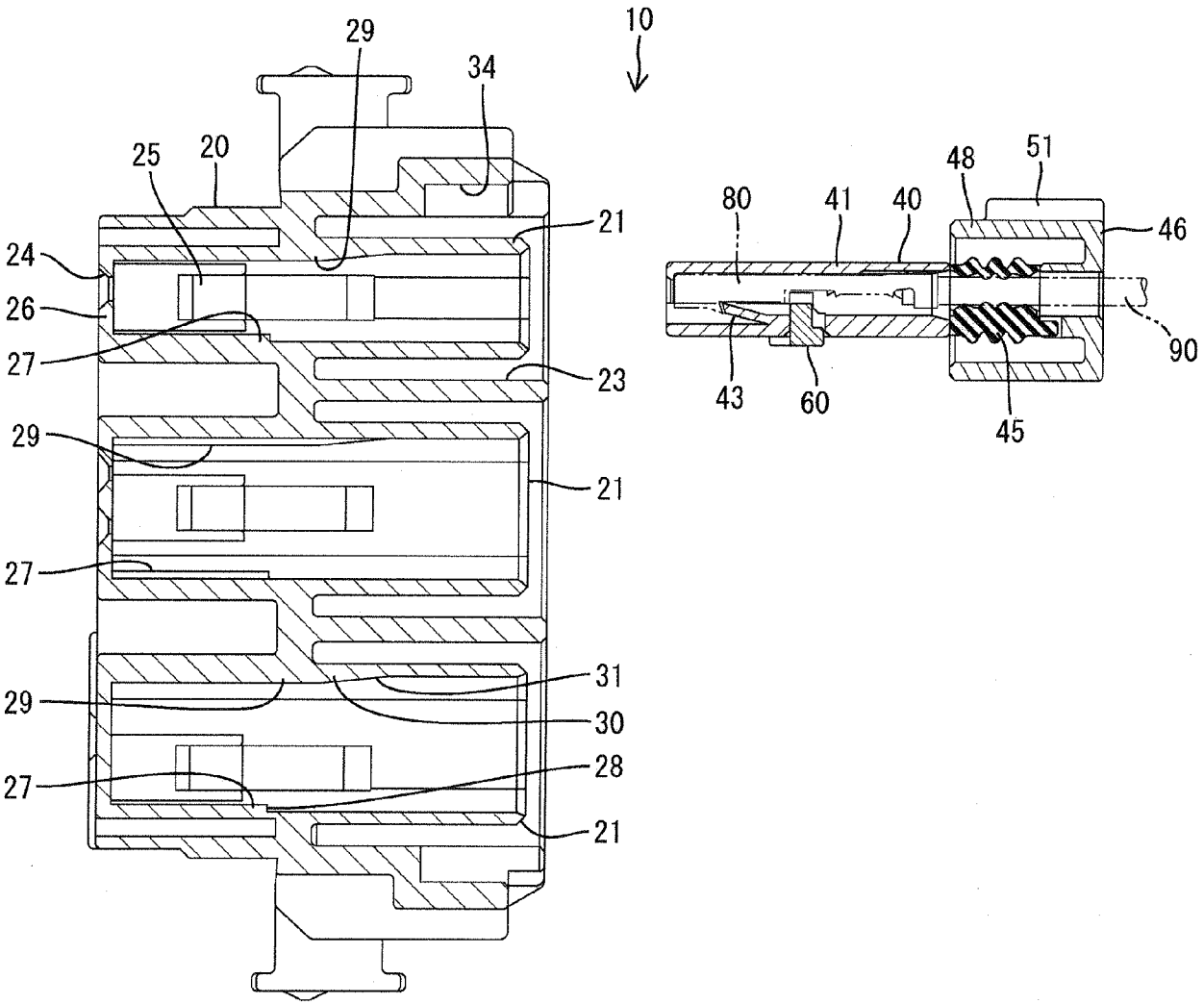
FIG. 2 is a sectional view showing a second housing fit in a first housing when a retainer is at a temporary locking position.
Figure 3:
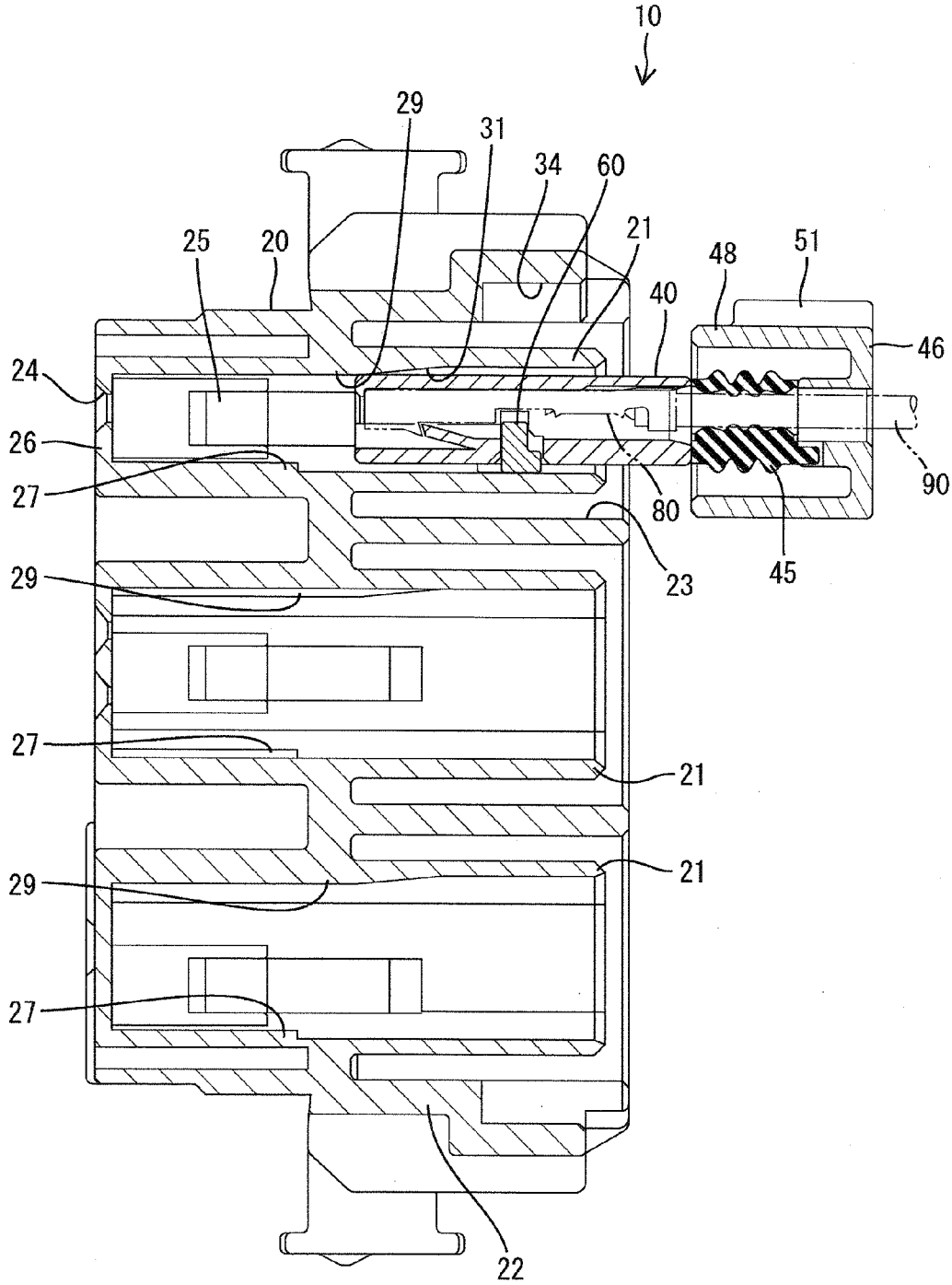
FIG. 3 is a sectional view of an operation of fitting the second housing in a first housing when the retainer is at the temporary locking position.
Figure 4:
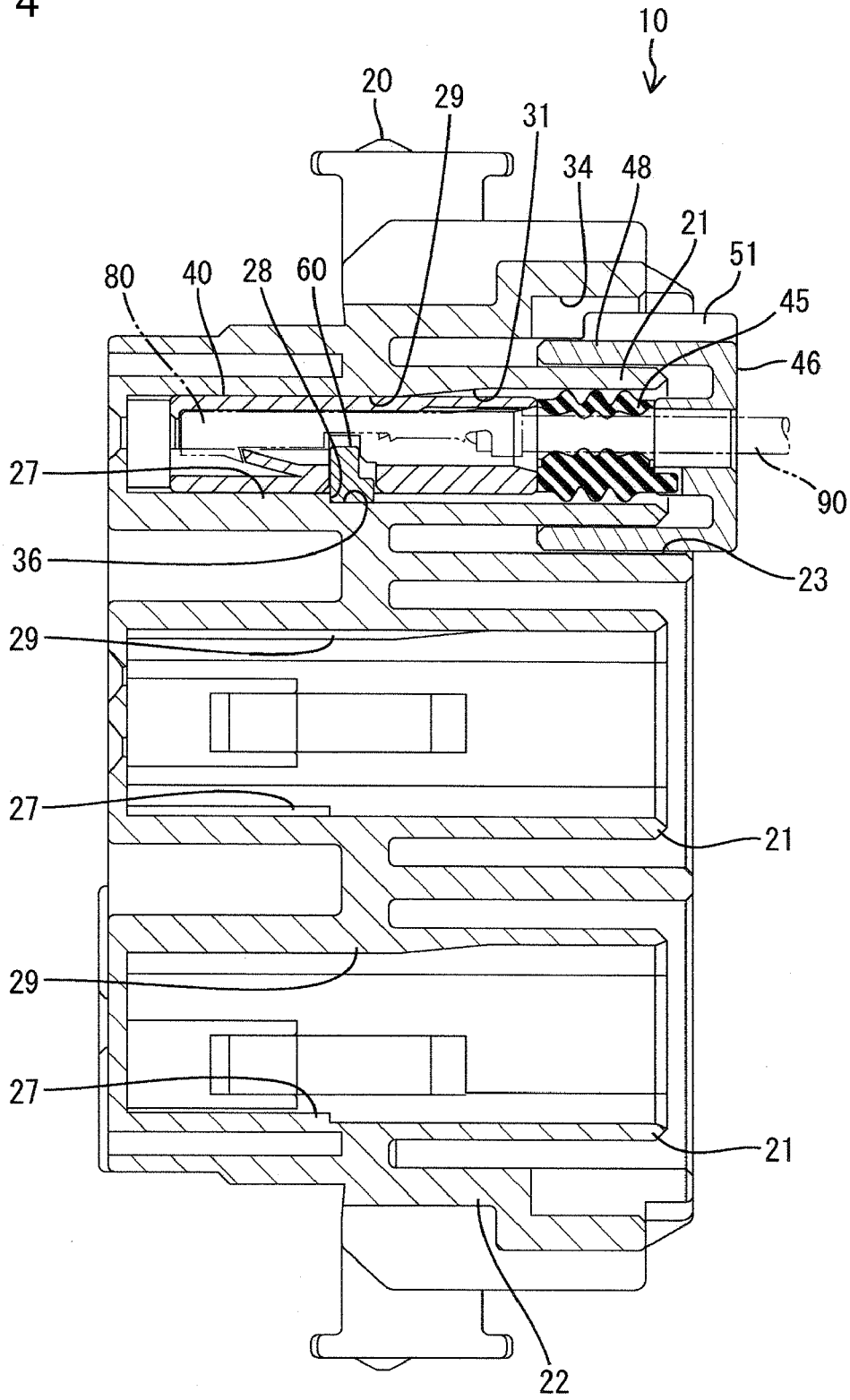
FIG. 4 is a sectional view with the retainer striking against a striking part and thus preventing the fitting of the second housing into the first housing.
Figure 5:
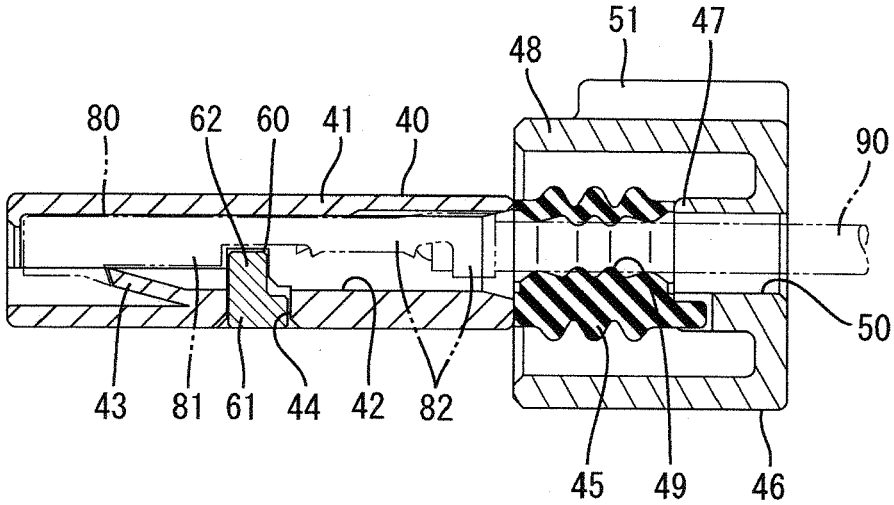
FIG. 5 is a sectional view showing the retainer at a main locking position.
Figure 6:
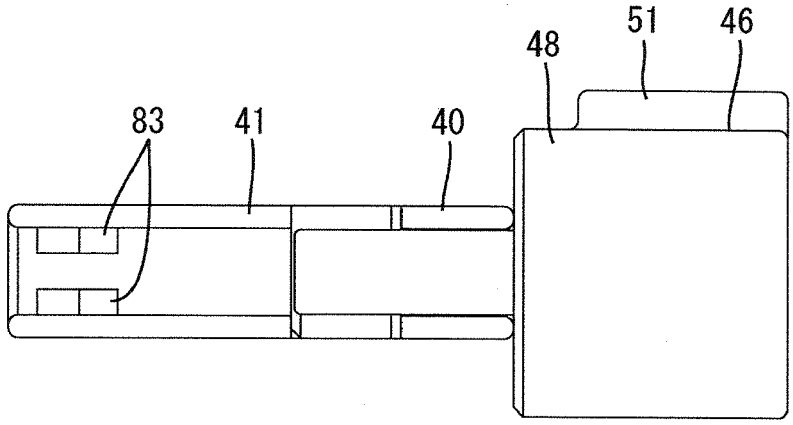
FIG. 6 is a side view showing the retainer at the main locking position.
Figure 7:
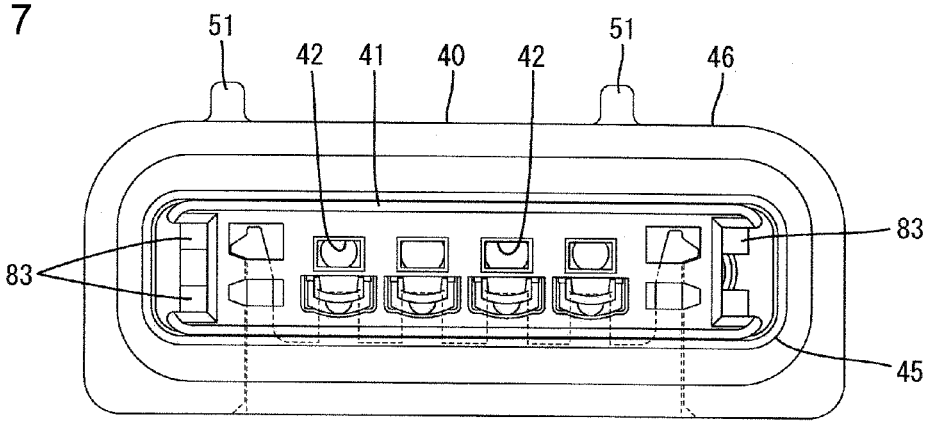
FIG. 7 is a front view showing the retainer at the main locking position.
Figure 8:
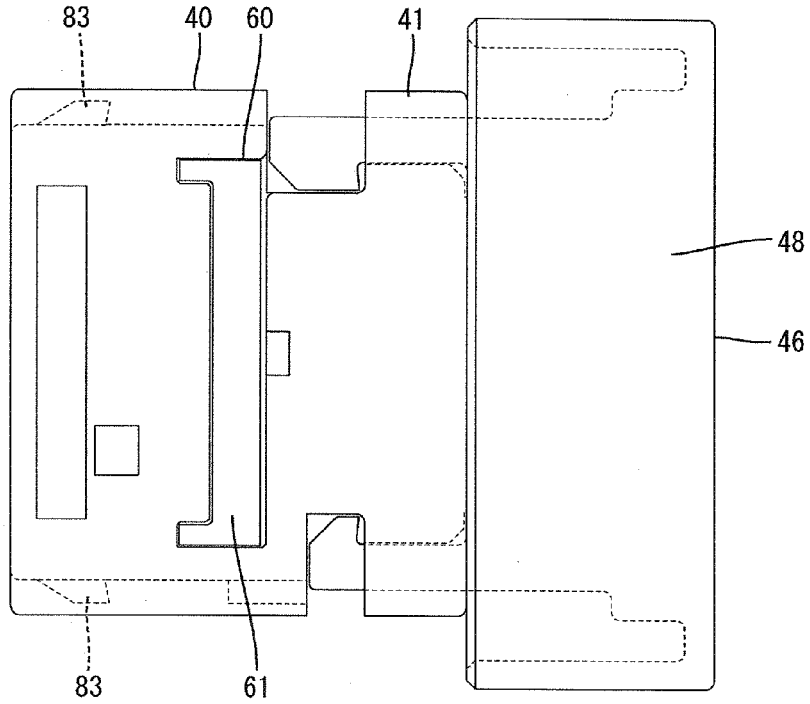
FIG. 8 is a bottom view showing the retainer at the main locking position.

If the retainer 60 is held midway between the temporary locking position and the main locking position or at the temporary locking position, the lower end of the retainer body 61 of the retainer 60 projects from the housing body 41 (see FIG. 2). Therefore when the second housing 40 is displaced to the striking part 27 by the guide 29, the lower front edge of the retainer body 61 of the partly inserted retainer 60 strikes against the striking surface 28 of the striking part 27. Thus, progress of the second housing 40 into the hood 21 is stopped (see FIGS. 3 and 4). At this time, even if the retainer 60 has a widthwise inclined state in a range in which the second housing 40 moves freely inside the hood 21, the retainer 60 strikes against the left or right striking part 27 positioned in the direction in which the retainer 60 has inclined. Therefore because the progress of the second housing 40 into the hood 21 is stopped, the operator can detect that the retainer 60 is in the partly-inserted state. With the partly inserted retainer 60 being struck against the striking part 27, the lower front corner of the retainer body 61 is fit on an approximately L-shaped step 36 between the striking surface 28 of the striking part 27 and the inner surface of the hood 21.

As described above, when the retainer 60 is in the partly-inserted state, the second housing 40 slides along the guide 29 in the process of fitting the second housing 40 in the hood 21. Thus, the second housing 40 is displaced to the striking part 27 and strikes against the striking part 27. Thus the operation of fitting the second housing 40 in the hood 21 cannot proceed any more. Therefore it is possible to securely detect that the retainer 60 is placed in the partly-inserted state.

The front end of each guide 29 is more distant from the rear wall 26 of the hood 21 than the front end of the striking part 27. The construction is simple, and yet the guide 29 securely guides the second housing 40, and the retainer 60 can be securely struck against the striking part 27.

The retainer 60 is in approximately the middle of the second housing 40 in the direction in which the second housing 40 is fitted in the hood 21. Thus, it is possible to detect that the retainer 60 is in the partly-inserted state when the second housing 40 is fit in the hood 21 to a certain depth. Consequently the connector has a high reliability in its performance of detecting the partly-inserted state of the retainer 60.

The striking parts 27 are at central portions and both end portions of the first housing 20 in its width direction in correspondence to the positions of retainers 60. Thus when the retainer 60 placed in the partly-inserted state inclines leftward or rightward inside the hood 21, the retainer 60 strikes against the left or right striking part 27. Consequently the connector is highly reliable at detecting the partly-inserted state of the retainer 60.

The invention is not limited to the embodiments described above, and the following embodiments also are included in the scope of the invention.

The mating terminal fitting may be mounted on the first housing to electrically connect both terminal fittings to each other upon fitting the second housing in the hood.

A projection may be formed on the outer surface of the retainer. At the temporary locking position, only the projection projects from the outer surface of the second housing and strikes against the striking part when the retainer is in the partly-inserted state.

The connector may be constructed that when the retainer is at the main locking position, the retainer body projects from the outer surface of the second housing body to a low extent or displaced into the second housing body.

What is claimed is:

1. A connector comprising:

a first housing and at least one tubular hood projecting on the first housing, the hood having an open front end and first and second opposed inner surfaces;

at least one second housing that can be fit in the hood;

a terminal fitting mounted in said second housing;

a retainer mounted in said second housing and moveable between a temporary locking position where the terminal fitting can be inserted into the second housing or removed from the second housing and a main locking position where the retainer prevents the terminal fitting from being removed from said second housing, a part of the retainer projecting out from the second housing when the retainer has not reached the main locking position;

a striking part projecting from the first inner surface of the hood; and a guide projecting from the second inner surface of the hood and guiding the second housing toward the striking part during insertion of the second housing into the hood, wherein the retainer that is not in the main locking position strikes against the striking part to prevent further insertion of the second housing into the hood.

2. The connector of claim 1, wherein a front end of the guide is more distant from a rear wall of the hood than a front end of the striking part.

3. The connector of claim 1, wherein said retainer is disposed in approximately a middle of said second housing in a direction in which the second housing is fit in said hood of said first housing.

4. The connector of claim 1, wherein the first housing has plural striking parts disposed respectively at a central portion and both sides of said first housing in correspondence to positions of retainer in a width direction orthogonal to the direction in which the second housing is fit in the hood of said first housing.

5. The connector of claim 1, wherein the at least one hood comprises plural hoods on the first housing and the at least one second housing comprises plural second housings.

6. The connector of claim 1, wherein the guide is sloped gradually to greater projecting distances from the second inner surface of the hood at further distances from the open front end of the hood.

7. The connector of claim 6, wherein the striking part has a front end aligned substantially perpendicular to the first inner surface of the hood.

8. The connector of claim 6, wherein the striking part has a front end aligned substantially perpendicular to an insertion direction of the second housing into the hood.

9. The connector of claim 8, wherein the guide is closer to the open front end of the hood than the striking part.

10. The connector of claim 9, wherein the hood has three of the striking parts and three of the guides substantially aligned respectively with the striking parts.

* * * * *